US007363797B2

(12) United States Patent
Kawasaki et al.

(10) Patent No.: US 7,363,797 B2
(45) Date of Patent: Apr. 29, 2008

(54) PROCESS FOR PRODUCING CORRUGATED PLATE AND DEVICE FOR PRODUCING CORRUGATED PLATE

(75) Inventors: Yoshiaki Kawasaki, Shizuoka (JP); Michio Ono, Shizuoka (JP); Tetsuya Ogawa, Saitama (JP); Tadashi Tsunoda, Saitama (JP)

(73) Assignees: Suruga Seiki Co., Ltd., Shizuoka (JP); Honda Motor Co., Ltd., Tokyo (JP)

( * ) Notice: Subject to any disclaimer, the term of this patent is extended or adjusted under 35 U.S.C. 154(b) by 310 days.

(21) Appl. No.: 10/956,337

(22) Filed: Oct. 4, 2004

(65) Prior Publication Data

US 2005/0103087 A1 May 19, 2005

(30) Foreign Application Priority Data

Oct. 7, 2003 (JP) ..... 2003-348588

(51) Int. Cl.
*B21D 22/00* (2006.01)

(52) U.S. Cl. ..... 72/361; 72/420; 72/385

(58) Field of Classification Search ..... 72/385, 72/381, 307, 420, 361
See application file for complete search history.

(56) References Cited

U.S. PATENT DOCUMENTS 3,798,956 A * 3/1974 Kopczynski ..... 72/420
3,885,410 A * 5/1975 Kopczynski ..... 72/307

FOREIGN PATENT DOCUMENTS

JP 8-83871 3/1996

* cited by examiner

*Primary Examiner*—Derris H. Banks
*Assistant Examiner*—Debra M Wolfe
(74) *Attorney, Agent, or Firm*—Squire, Sanders & Dempsey L.L.P.

(57) ABSTRACT

A device and a process for producing a corrugated plate having a plurality of bent-into-contact portions extending in parallel on one face of a metal plate employs a number of steps. A first pressing step sequentially molds a plurality of U-shaped bent portions in the metal plate. A second pressing step sequentially molds the bent-into-contact portions by sequentially crushing the plurality of U-shaped bent portions. In the first pressing step, the U-shaped bent portions are fed in a direction orthogonal to the direction of the U-shaped bent portions, and positioned, and are pressed in a state in which the position is released. In the second pressing step, another face of the metal plate is pressed flat while molding the bent-into-contact portions by pressing the U-shaped bent portions from both sides.

2 Claims, 7 Drawing Sheets

21
24
23
22a
22
16
16b'
5

PROCESS FOR PRODUCING CORRUGATED PLATE AND DEVICE FOR PRODUCING CORRUGATED PLATE

BACKGROUND OF THE INVENTION

1. Field of the Invention

The present invention relates to a process for producing a corrugated plate having, on one face of a metal plate, a plurality of bent-into-contact portions extending in parallel and projecting in a ridge shape at predetermined intervals. The invention also relates to a device for producing the corrugated plate.

2. Description of the Related Art

A process for producing a channel fin for dissipating heat generated by an IC package is known from Japanese Patent Application Laid-open No. 8-83871. This channel fin is a corrugated plate having, on one face of a metal plate, a plurality of bent-into-contact portions extending in parallel and projecting in a ridge shape at predetermined intervals. The production process therefor includes a first step of molding a U-shaped bent portion by lowering a punch toward a thin starting plate supported on upper faces of a fixed die and a movable die so that the punch pushes the thin starting plate in between the fixed die and the movable die, and a second step of retracting the punch upward and then molding a heat dissipating portion by moving the movable die toward the fixed die so that the U-shaped bent portion is crushed into intimate contact.

In the first step of the above-mentioned conventional production process for the channel fin, a fresh U-shaped bent portion is molded in the thin starting plate by repeating the first step while the heat dissipating portion molded in the previous second step is fitted in a movable die groove formed in the movable die so as to position the starting thin plate. Although the heat dissipating portion is restrained by the movable die groove on the movable die side, the thin starting plate is not restrained on the opposite fixed die side. Therefore, when the punch descends between the fixed die and the movable die, it is not possible to draw in the thin starting plate on the movable die side of the U-shaped bent portion, which makes it easy for thinning to occur, but it is possible to draw in the thin starting plate on the fixed die side of the U-shaped bent portion, which makes it difficult for thinning to occur. As a result, the thickness of the U-shaped bent portion becomes uneven, thereby leading to a problem that the precision of the final product is affected.

Furthermore, when the U-shaped bent portion is crushed by moving the movable die toward the fixed die in the second step, the upper face of the thin starting plate is not pressed down. Therefore, the thin starting plate lifts up at the base of the heat dissipating portion, thus leading to a problem that the flatness is degraded.

SUMMARY OF THE INVENTION

The present invention has been achieved under the above-mentioned circumstances, and it is an object thereof to produce with high precision a corrugated plate having a plurality of bent-into-contact portions extending in parallel on one face of a metal plate and projecting in a ridge shape at predetermined intervals.

In order to attain this object, in accordance with a first aspect of the present invention, there is proposed a process for producing a corrugated plate having a plurality of bent-into-contact portions extending in parallel on one face of a metal plate and projecting in a ridge shape at predetermined intervals, the process including a first pressing step of sequentially molding a plurality of U-shaped bent portions in the metal plate, and a second pressing step of sequentially molding the bent-into-contact portions by sequentially crushing the plurality of U-shaped bent portions, wherein, in the first pressing step, the U-shaped bent portions are fed in a direction orthogonal to the direction of the U-shaped bent portions and positioned, and are pressed in a state in which the positioning is released, and wherein, in the second pressing step, the other face of the metal plate is pressed flat while molding the bent-into-contact portions by pressing the U-shaped bent portions from both sides.

Furthermore, in accordance with a second aspect of the present invention, in addition to the first aspect, subsequent to the second pressing step, the process includes a third pressing step of supporting a flat portion of said one face of the metal plate and pressing flat said other face.

Moreover, in accordance with a third aspect of the present invention, in addition to the first or second aspect, the corrugated plate is a first heat-transfer plate forming a heat exchanger in cooperation with a second heat-transfer plate.

Furthermore, in accordance with a fourth aspect of the present invention, there is proposed a device for producing a corrugated plate, the device carrying out the first pressing step of the process for producing the corrugated plate according to the first aspect, wherein the device includes feeding means for intermittently feeding a metal plate, a positioning member fixed to an end portion, in the feed direction, of the metal plate and having a plurality of notches with a pitch equal to a feed pitch for the metal plate, a positioning pawl that moves back and forth so that it can engage with and disengage from the notches of the positioning member, and a mold for molding a U-shaped bent portion in the metal plate, wherein, after positioning the metal plate by engaging the positioning pawl with a predetermined notch of the positioning member for the metal plate fed by the feeding means, in a state in which the positioning pawl is disengaged from the notch, the metal plate is pressed by the mold so as to mold the U-shaped bent portion.

Moreover, in accordance with a fifth aspect of the present invention, there is proposed a device for producing a corrugated plate, the device carrying out the second pressing step of the process for producing the corrugated plate according to the first aspect, wherein the device includes first and second dies that open and close in a first direction in order to mold a bent-into-contact portion by crushing the U-shaped bent portion of the metal plate, a punch that moves back and forth in a second direction orthogonal to the first direction, and a cam mechanism that closes the first and second dies in the first direction by means of a pressing force of the punch moving forward in the second direction.

Furthermore, in accordance with a sixth aspect of the present invention, in addition to the fifth aspect, the first and second dies are capable of moving in the second direction, the cam mechanism includes a first inclined cam face provided on a fixed member and a second inclined cam face that is provided on the first die and abuts slidably against the first inclined cam face, and when the first and second dies move in the second direction by means of the pressing force of the punch, the first die closes in the first direction toward the second die by virtue of a reaction force of the fixed member.

In accordance with the arrangement of the first aspect, in the first pressing step, one face of the metal plate is pressed to form the U-shaped bent portion in a state in which the positioning is released after positioning the metal plate by feeding it by a predetermined amount. Therefore, it is possible to draw in the metal plate evenly from both sides of the U-shaped bent portion, thus preventing thinning, and to make the thickness of the U-shaped bent portion uniform, thus preventing distortion from occurring. In the second pressing step, while molding the bent-into-contact portion by pressing the U-shaped bent portion from both sides, the other face of the metal plate is pressed flat. Therefore, it is possible to prevent said other face of the metal plate from lifting and give it a flat finish.

In accordance with the arrangement of the second aspect, in the third pressing step subsequent to the second pressing step, while the flat portion of said one face of the metal plate is supported, said other face thereof is pressed flat. Therefore, it is possible to give a flatter finish to said other face of the metal plate.

In accordance with the arrangement of the third aspect, by using the corrugated plate as a heat-transfer plate of a heat exchanger, it is possible to enhance the precision of the heat exchanger.

In accordance with the arrangement of the fourth aspect, the metal plate is fed intermittently by the feeding means, and after positioning the metal plate precisely by engaging the positioning pawl with the notch of the positioning member fixed to the metal plate, in a state in which the positioning pawl is disengaged from the notch, the metal plate is pressed by the mold so as to mold the U-shaped bent portion. Therefore, it is possible to draw in the metal plate evenly from both sides of the U-shaped bent portion, thus preventing thinning, and to make the thickness of the U-shaped bent portion uniform, thus preventing distortion from occurring.

In accordance with the arrangement of the fifth aspect, there are provided the first and second dies that open and close in the first direction and the punch that moves back and forth in the second direction orthogonal to the first direction. Therefore, it is possible to mold the bent-into-contact portion by crushing the U-shaped bent portion of the metal plate by means of the first and second dies and, at the same time, to prevent said other face of the metal plate from lifting and give it a flat finish by means of the punch. Moreover, since the first and second dies are closed in the first direction via the cam mechanism by means of the pressing force of the punch moving forward in the second direction, it is unnecessary to employ a special drive source in order to close the first and second dies, thereby simplifying the structure.

In accordance with the arrangement of the sixth aspect, the cam mechanism is formed from the first inclined cam face provided on the fixed member and the second inclined cam face provided on the first die; when the first and second dies move in the second direction by means of the pressing force of the punch, the first die closes in the first direction toward the second die by virtue of the reaction force of the fixed member. Therefore, it is possible to close the first and second dies with a simple structure and mold the bent-into-contact portion.

BRIEF DESCRIPTION OF DRAWINGS

A mode for carrying out the present invention is explained below with reference to an embodiment of the present invention shown in the attached drawings, wherein.

DETAILED DESCRIPTION OF THE PREFERRED EMBODIMENT(S)

Figure 1:
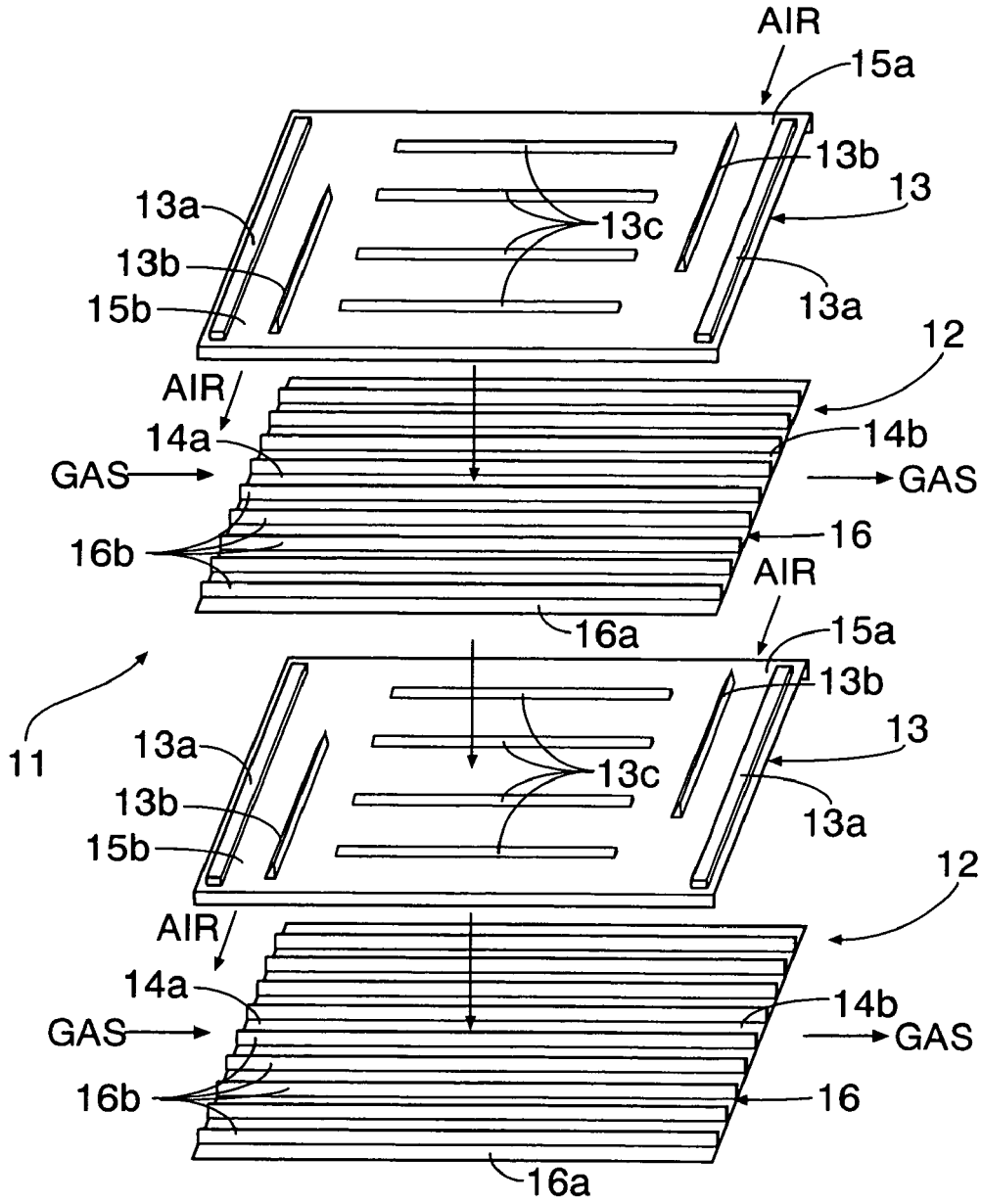
FIG. 1 is an exploded perspective view of a heat exchanger.
Figure 2:
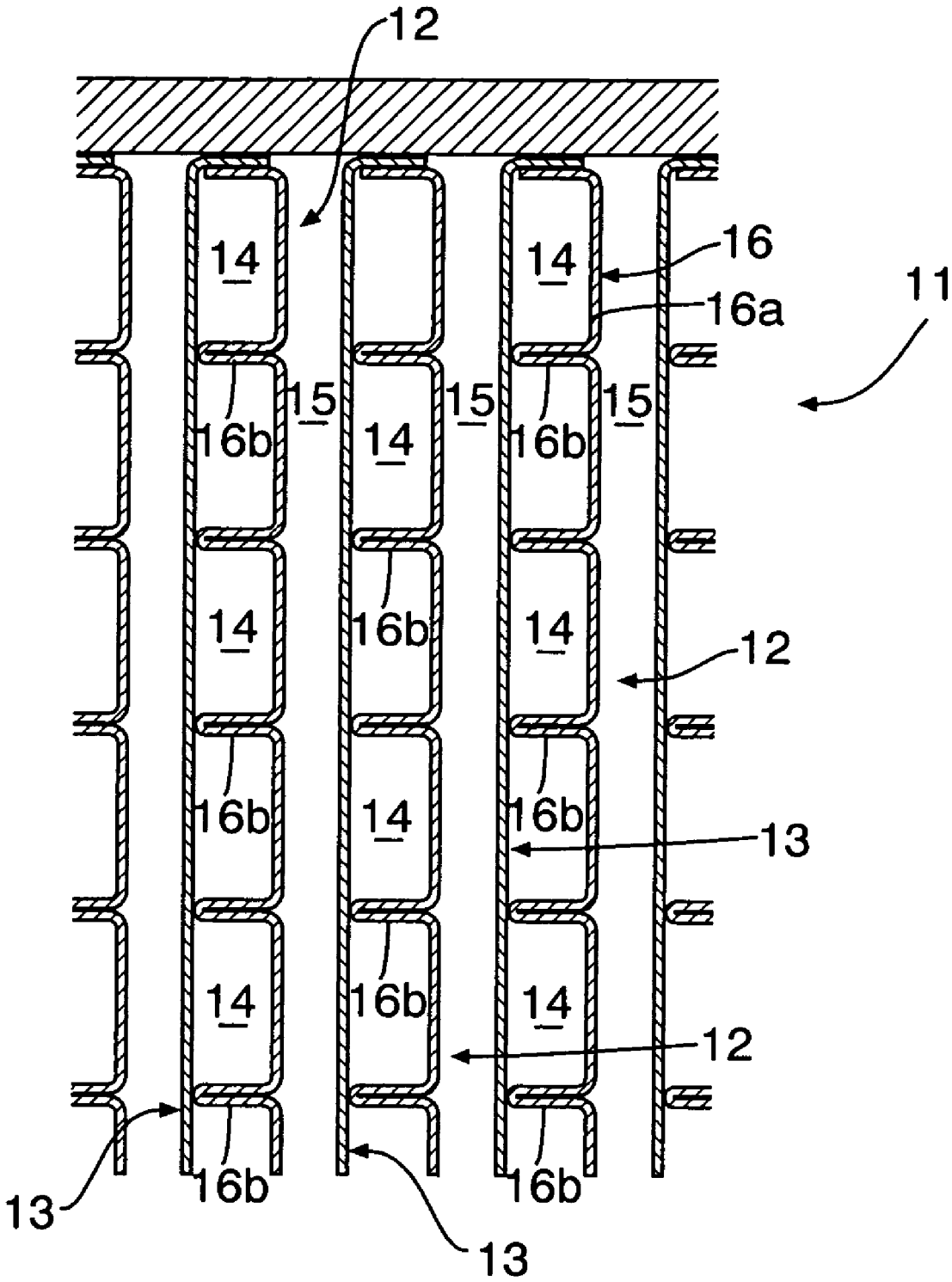
FIG. 2 is a partial sectional view of the heat exchanger.

As shown in FIG. 1 and FIG. 2, a heat exchanger 11 used for a gas turbine engine can be formed by alternately stacking and brazing a first heat-transfer plate 12 and a second heat-transfer plate 13. Alternately formed between the first and second heat-transfer plates 12 and 13 can be a gas passage 14 through which high temperature gas passes and an air passage 15 through which low temperature air passes.

In this example, the first heat-transfer plate 12 has a large number of bent-into-contact portions 16*b* projecting in parallel ridge shapes from one face of a flat portion 16*a* of a metal plate 16. Tips of the bent-into-contact portions 16*b* are brazed to a flat face of the second heat-transfer plate 13. The second heat-transfer plate 13 has projections 13*a*, 13*b*, and 13*c* projectingly provided on the other face thereof. Tips of the projections 13*a*, 13*b*, and 13*c* can be brazed to a flat face of another first heat-transfer plate 12. As a result, in this example, the gas passage 14 is a linear passage having a gas inlet 14*a* and a gas outlet 14*b*, and the air passage 15 is a crank-shaped passage having an air inlet 15*a* and an air outlet 15*b*.

Figure 3:
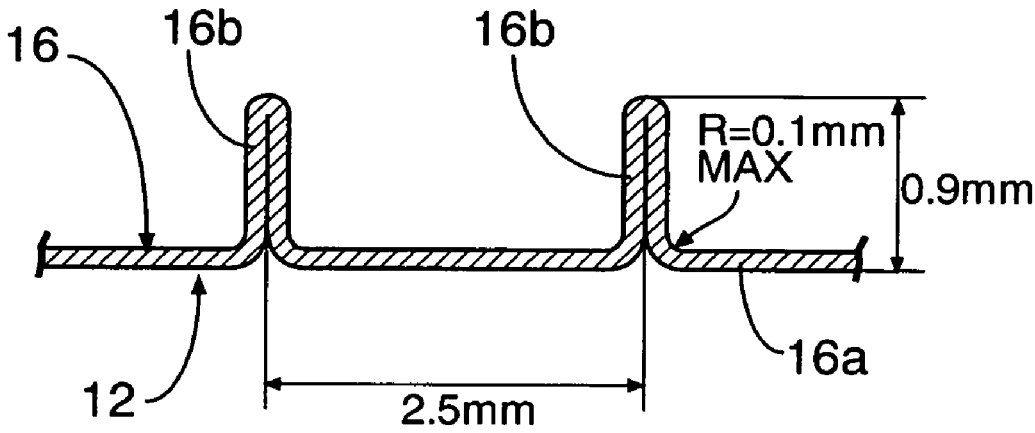
FIG. 3 is a partial perspective view of a first heat-transfer plate.
Figures 4A, 4B, 4C:
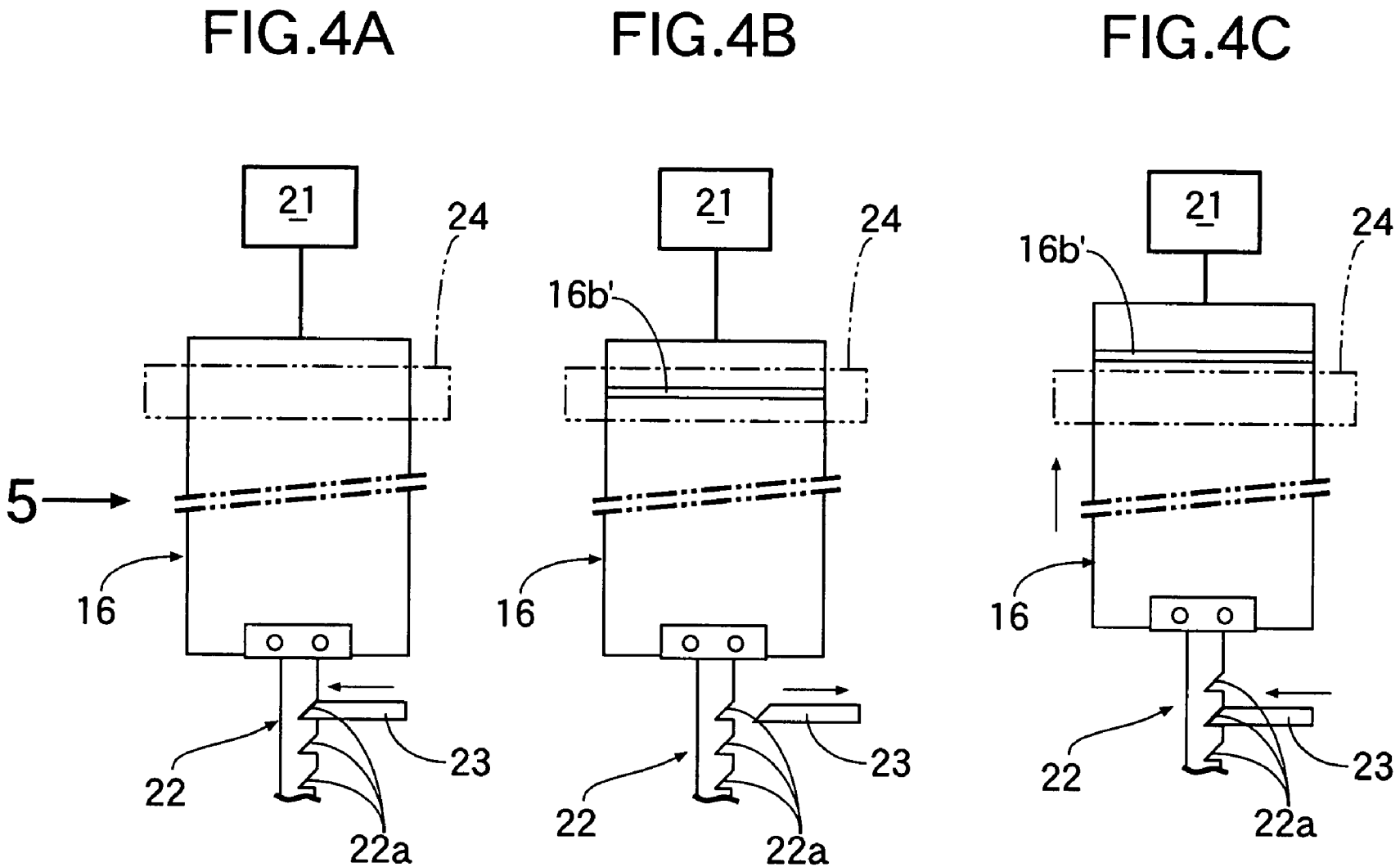
FIGS. 4A, 4B, and 4C are plan views of an example of a pressing device for a first pressing step.
Figure 5A:
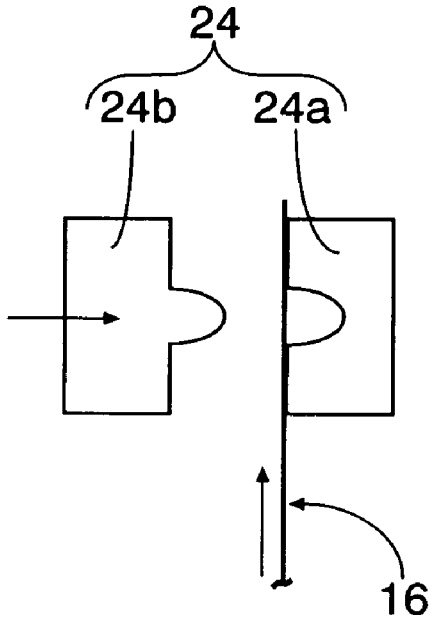
FIGS. 5A and 5B are sectional views from an arrow 5 in FIG. 4.
Figure 5B:
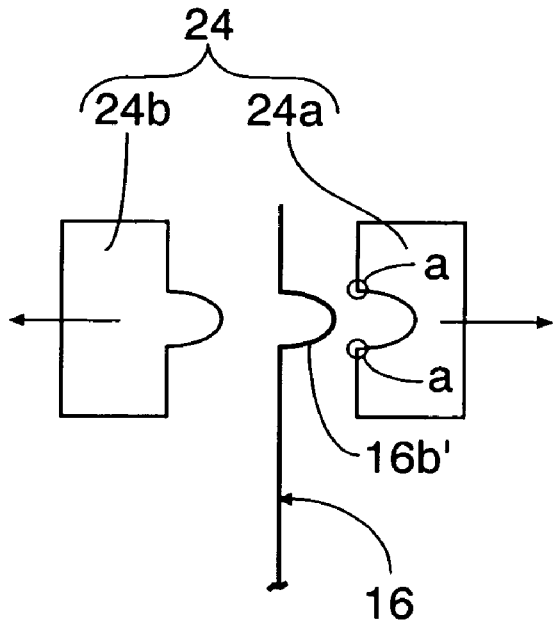

FIG. 3 shows an example of a detailed shape of the first heat-transfer plate 12. In the embodiment, the metal plate 16 is a stainless plate having a thickness of 0.1 mm, and the bent-into-contact portions 16*b* have a pitch of 2.5 mm, a height of 0.9 mm, and a maximum radius of curvature at the base of 0.1 mm. The tolerance in the pitch is ±0.05 mm, and the tolerance in the height is 0 mm to −0.03 mm. These dimensions are exemplary only.

One example of a production process for the first heat-transfer plate 12 includes a first pressing step of press-forming U-shaped bent portions 16*b*' in the metal plate 16, a second pressing step of press-forming bent-into-contact portions 16*b* in the U-shaped bent portions 16*b*', and a third pressing step of press-forming the other face flat (face on which no bent-into-contact portions 16*b* are formed) of the first heat-transfer plate 12.

As shown in FIGS. 4A to 4C and FIGS. 5A and 5B, a pressing device for carrying out the first pressing step can include a feeding unit or feeding means 21 for feeding the metal plate 16 intermittently at the above-mentioned pitch, while holding the leading edge in the feed direction of the metal plate 16. A positioning member 22 can be fixed to the rear end in the feed direction of the metal plate 16. A large number of notches 22*a* are formed in the positioning member 22 with the same pitch as the above-mentioned pitch. A positioning pawl 23 is provided, that moves back and forth in a direction orthogonal to the feed direction of the metal plate 16 and is capable of engaging with and disengaging from the notches 22*a*. Mold 24 is provided for press-forming the U-shaped bent portions 16*b*' in the metal plate 16. The mold 24 is formed from a die 24*a* having a U-shaped recess and a punch 24*b* having a U-shaped protrusion. In order to enable the metal plate 16 to be drawn in easily, the recess of the die 24*a* has rounded edges a having a radius of curvature of on the order of 0.1 mm.

In the first pressing step, by engaging the positioning pawl 23 with the notch 22*a* that is closest to the metal plate 16 among the large number of notches 22*a* of the positioning member 22, the metal plate 16 can be positioned appropriately in the feed direction. Subsequently, immediately after the positioning pawl 23 is disengaged from the notch 22*a* so as to release the restraint of the metal plate 16, the die 24*a* and the punch 24*b* of the mold 24 are closed so as to press-mold the U-shaped bent portion 16*b*'. During this process, since the restraint of the metal plate 16 by the positioning pawl 23 and the notch 22*a* is released, and the edges a of the recess of the die 24*a* are rounded, it is possible to draw in the metal plate 16 evenly from both sides of the U-shaped bent portion 16*b*', thus preventing thinning and molding the U-shaped bent portion 16*b*' so that it has a uniform thickness.

When the first U-shaped bent portion 16*b*' is molded in this way, the feeding means 21 feeds the metal plate 16 by a distance corresponding to one pitch, the metal plate 16 is then positioned precisely by engaging the positioning pawl 23 with the notch 22*a* that is second from the side closer to the metal plate 16, and the positioning pawl 23 is then disengaged from the notch 22*a* so as to release the restraint of the metal plate 16. In this state, the die 24*a* and the punch 24*b* of the mold 24 are closed so as to press-mold the second U-shaped bent portion 16*b*. By repeating the above-mentioned operation, a large number of U-shaped bent portions 16*b*' can be molded in the metal plate 16 with high precision.

Since the positioning member 22 is disposed horizontally, and the notches 22*a* are formed on a side face thereof, dust attached to the notch 22*a* easily falls by virtue of gravity, and the precision of the positioning by the positioning pawl 23 is not degraded by the dust attached to the notch 22*a*.

Figure 6B:
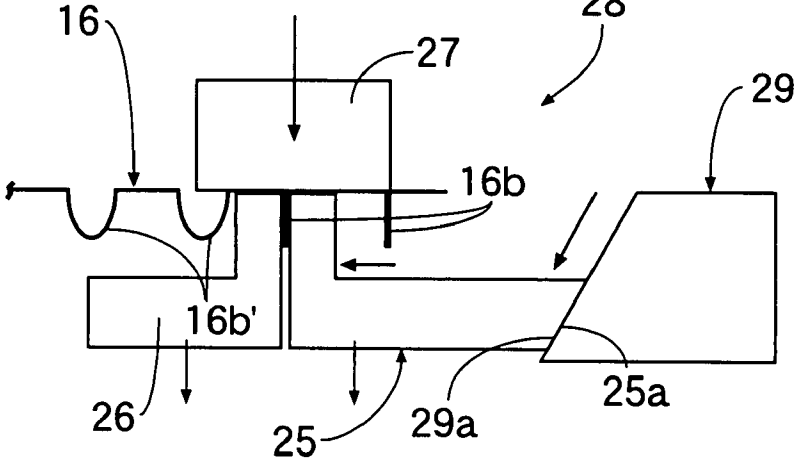
FIGS. 6A and 6B are front views of an example of a pressing device for a second pressing step.
Figure 6A:
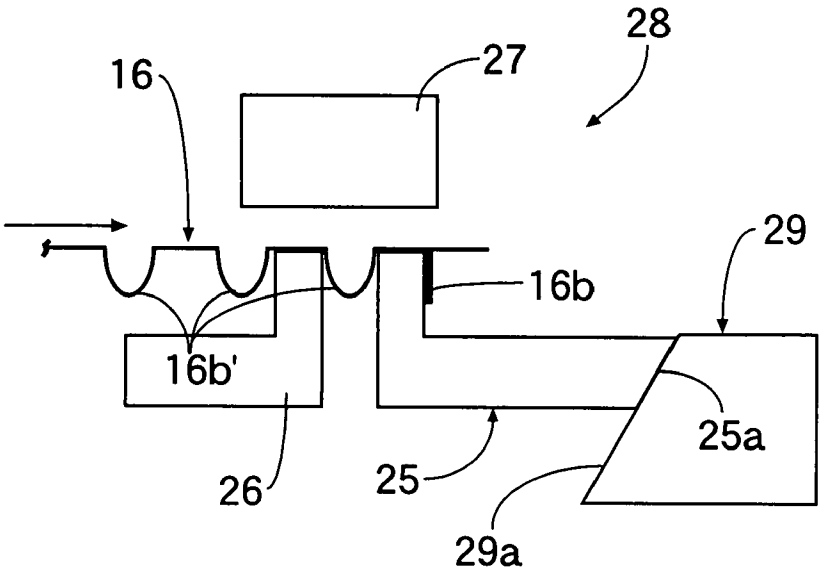

As shown in FIGS. 6A and 6B, an example of a pressing device for carrying out the second pressing step includes a mold 28 formed from a first die 25, a second die 26, and a punch 27. The second die 26 can be movable only in a direction orthogonal to the feed direction of the metal plate 16, and the first die 25 is movable both in the feed direction of the metal plate 16 and in the direction orthogonal thereto. A first inclined cam face 29*a* is formed on a side face of a fixed member 29 that is fixed so that it cannot move. A second inclined cam face 25*a* that engages slidably with the first inclined cam face 39*a* is formed on a side face of the first die 25. The punch 27 is movable, relative to the first and second dies 25 and 26, in the direction orthogonal to the feed direction of the metal plate 16.

In the second pressing step, the punch 27 is firstly lowered toward the metal plate 16 while the U-shaped bent portion 16*b*' of the metal plate 16 is positioned so as to be interposed between the first and second dies 25 and 26 which are separated from each other. When the metal plate 16 abuts against the first and second dies 25 and 26 as a result of being pushed by the punch 27, the punch 27, the metal plate 16, and the first and second dies 25 and 26 descend as one unit. At this point, the second inclined cam face 25*a* of the descending first die 25 is guided by the first inclined cam face 29*a* of the fixed member 29, and the first die 25 moves toward the second die 26 so as to press-form and crush the U-shaped bent portion 16*b*' of the metal plate 16, thus molding the bent-into-contact portions 16*b*. Since the first die 25 can be driven toward the second die 26 by utilizing a drive force for making the punch 27 descend, it is unnecessary to employ a special drive source for driving the first die 25, thereby simplifying the structure of the mold 28.

When the U-shaped bent portion 16*b*' is crushed by the first and second dies 25 and 26, the base of the U-shaped bent portion 16*b*' attempts to rise up, but by pressing this portion from above with the punch 27 the other face (the face where no bent-into-contact portion 16*b* is formed) of the metal plate 16 can be molded flat.

Figure 7:
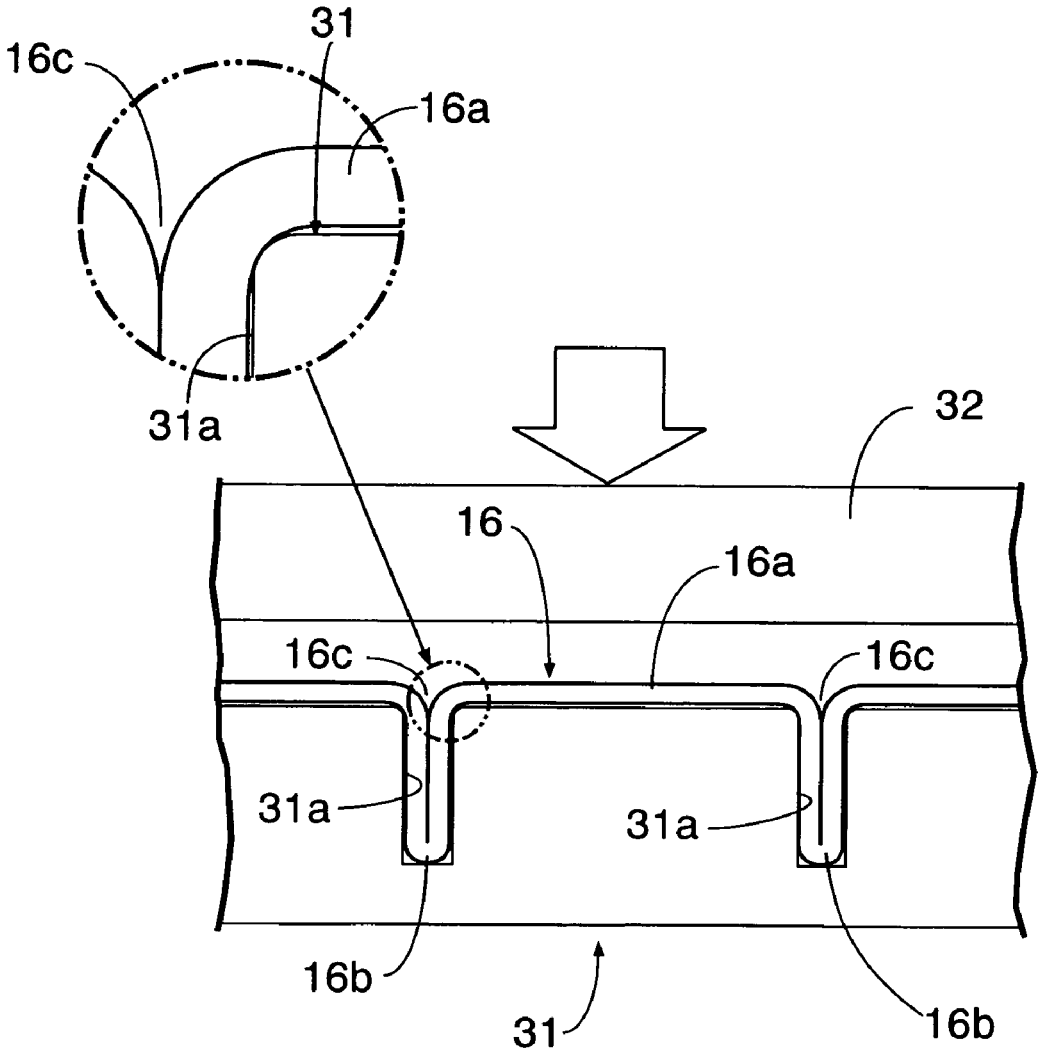
FIG. 7 is a front view of an example of a pressing device for a third pressing step.

As shown in FIG. 7, an example of a pressing device for carrying out the third pressing step can include a mold formed from a die 31 and a punch 32. The die 31 has a plurality of recesses 31*a* formed therein. By lowering the punch 32 so as to push the flat portion 16*a* of the metal plate 16 while the bent-into-contact portions 16*b* of the metal plate 16 are housed in these recesses 31*a*, it is possible to make grooves 16*c* of the bent-into-contact portions 16*b* as shallow as possible. Thus, when the flat portions 16*a* at opposite ends of the first heat-transfer plate 12 are brazed to the projections 13*a* of the second heat-transfer plate 13, it is possible to prevent a brazing material from flowing along the grooves 16*c* of the bent-into-contact portions 16*b*.

Although an embodiment of the present invention has been described above, the present invention can be modified in a variety of ways without departing from the subject matter thereof.

For example, in the embodiment, the first heat-transfer plate 12 of the heat exchanger 11 is illustrated as the corrugated plate, but the present invention is applicable to a corrugated plate used for any purpose.

The invention claimed is:

1. A device for producing a corrugated plate, comprising:

feeding means for intermittently feeding a metal plate;

a positioning member fixed to an end portion, in a feed direction, of the metal plate and having a plurality of notches with a pitch equal to a feed pitch for the metal plate;

a positioning pawl that moves back and forth, in a direction orthogonal to the feed direction of the metal plate, so that the positioning pawl can engage with and disengage from notches of the positioning member; and a mold for molding a U-shaped bent portion in the metal plate;

wherein the feeding means, positioning member, positioning pawl, and the mold are configured to perform a pressing step of sequentially molding a plurality of U-shaped bent portions in the metal plate, wherein the U-shaped bent portions are fed in a direction orthogonal to the direction of the U-shaped bent portions and positioned, and are pressed in a state in which the position is released, and wherein, after positioning the metal plate by engaging the positioning pawl with a predetermined notch of the positioning member, the positioning pawl is disengaged from the predetermined notch so as to release the metal plate and the metal plate is then pressed by the mold so as to mold the U-shaped bent portion.

2. A device for producing a corrugated plate, comprising:

feeding means for intermittently feeding a metal plate;

a positioning means for positioning the metal plate, said positioning means fixed to an end portion, in a feed direction, of the metal plate and having a plurality of notches with a pitch equal to a feed pitch for the metal plate;

positioning pawl means for moving back and forth, in a direction orthogonal to the feed direction of the metal plate, so that the positioning pawl can engage with and disengage from notches of the positioning member; and mold means for molding a U-shaped bent portion in the metal plate;

wherein the feeding means, positioning means, positioning pawl means, and mold means are configured to perform a pressing step of sequentially molding a plurality of U-shaped bent portions in the metal plate, wherein the U-shaped bent portions are fed in a direction orthogonal to the direction of the U-shaped bent portions and positioned, and are pressed in a state in which the position is released, and wherein, after positioning the metal plate by engaging the positioning pawl means with a predetermined notch of the positioning means, the positioning pawl means is disengaged from the predetermined notch so as to release the metal plate and the metal plate is then pressed by the mold so as to mold the U-shaped bent portion.

* * * * *